United States Patent [19]

Fukui et al.

[11] Patent Number: 5,036,812

[45] Date of Patent: Aug. 6, 1991

[54] IDLE CONTROL DEVICE FOR AN INTERNAL COMBUSTION ENGINE

[75] Inventors: Wataru Fukui; Toshio Iwata, both of Himeji, Japan

[73] Assignee: Mitsubishi Denki K.K., Tokyo, Japan

[21] Appl. No.: 519,985

[22] Filed: May 1, 1990

[30] Foreign Application Priority Data

May 2, 1989 [JP] Japan ..... 1-112185
May 15, 1989 [JP] Japan ..... 1-118752

[51] Int. Cl.[5] ..... F02M 3/00
[52] U.S. Cl. ..... 123/339; 123/585
[58] Field of Search ..... 123/339, 585

[56] References Cited

U.S. PATENT DOCUMENTS 4,875,447 10/1989 Kiuchi et al. ..... 123/339
4,875,456 10/1989 Tomamaru ..... 123/585
4,877,002 10/1989 Shimomura et al. ..... 123/339
4,895,118 1/1990 Nakamura ..... 123/334
4,903,658 2/1990 Miyama et al. ..... 123/339
4,903,659 2/1990 Inagaki et al. ..... 123/339

FOREIGN PATENT DOCUMENTS 24778 6/1981 Japan ..... 123/339

*Primary Examiner*—Raymond A. Nelli
*Attorney, Agent, or Firm*—Sughrue, Mion, Zinn, Macpeak & Seas

[57] ABSTRACT

An idle control device for an internal combustion engine capable of controlling the idle speed of the engine in an appropriate manner over a wide operating range thereof and performing idle stabilization control when the engine operation is abnormal. In one embodiment, it is determined whether the engine is in a fast or a normal idling condition, and the number of engine rpm during fast idling is controlled to be at a target value which is higher than another target value for normal idling. In another embodiment, it is determined whether the operation of the engine is normal or abnormal, and the number of engine rpm is controlled to be at a target value when the operation of the engine is abnormal (i.e., the engine is likely to stall) even if the engine is erroneously determined to be out of idling due to sensor failure or the like.

14 Claims, 3 Drawing Sheets

IDLE CONTROL DEVICE FOR AN INTERNAL COMBUSTION ENGINE

BACKGROUND OF THE INVENTION

The present invention relates to an idle control device for controlling the idling speed of an engine.

In order to control operating conditions of an engine such as ignition timing, fuel injection and the like, signals are generally utilized which are generated by a signal generator in synchronism with the rotation of the engine. The signal generator generally senses the rotation of a crankshaft or camshaft operatively coupled therewith. An example of this type of signal generator is schematically illustrated in FIGS. 1 and 2. In FIG. 1, a signal generator in the form of a rotational position sensor is generally designated by reference numeral 8 and includes a rotating shaft 1 which is rotated in synchronism with the rotation of a multicylinder engine (not shown) which is, in this example, a four-cylinder engine, and rotary disk 2 secured at its center to the rotating shaft 1 for integral rotation therewith. The rotary disk 2 has a plurality of windows or slits 3 formed therein around the rotating shaft 1 in a circumferentially spaced relation with respect to each other. Each of the slits 3 corresponds to one of the cylinders of the engine, so for a four-cylinder engine, there are four slits in the disk 2. The slits 3 are equally distant from the center of the rotary disk 2. All the slits 3 have the same length as one another in the circumferential direction of the disk 2. Each of the slits 3 has a leading edge L and a trailing edge T. The leading edges L and the trailing edges T of all four slits 3 are equally spaced around the disk 2 at intervals of 90 degrees.

As shown in FIGS. 1 and 2, a light source in the form of a phototransistor 5 are disposed in alignment with each other on opposite sides of the rotary disk 2 in such a manner that when one of the slits 3 is aligned with the light emitting diodes 4 and the phototransistor 5, light emitted from the light emitting diode 4 can pass through the slit 3 thus aligned and reach the phototransistor 5, which is thereby turned on. At other times, the phototransistor 5 remains off.

In operation, when the light which is generated by the light emitting diode 4 passes through one of the slits 3 in the disk 2 and strikes the phototransistor 5, the phototransistor 5 conducts and current flows through the phototransistor 5 and a resistor 5A which is connected to the emitter of the phototransistor 5. An amplifier 6 amplifies the voltage across the resistor 5A and provides the amplified signal to the base of an open-collector output transistor 7.

FIG. 3 illustrates the output signal of the signal generator 8. The output signal is in the form of pulses having a rising edge corresponding to the leading edge L, and a falling edge corresponding to the trailing edge T of each slit 3 in the disk 2. In FIG. 3, a rising edge of an output pulse occurs when the position of the corresponding cylinder is at 5 degrees before top dead center (BTDC), whereas the falling edge occurs when the position of the corresponding cylinder is at 5 degrees BTDC. However, the piston positions corresponding to the rising and falling edges in FIG. 4 are just examples, and different values can be employed.

As shown in FIG. 4, the output signal of the signal generator 8 is inputted to a microcomputer 10 via an interface 9. Based on the output signal from the signal generator 8, the microcomputer 10 controls the ignition timing, the fuel injection, and other aspects of engine operation. For example, in order to stabilize the number of revolutions per minute of the engine, the microcomputer 10 determines successively the instantaneous number of revolutions per minute (rpm) of the engine, for example, by measuring the length of time between the rising or falling edges of two successive pulses of the generator output signal, calculates an average value of the thus determined instantaneous numbers of rpm per a predetermined number of rpm with the corresponding average value so as to obtain a deviation therefrom, and then controls to make a certain appropriate adjustment or modification of the ignition timing in dependence upon the deviation thus obtained.

With the known idle control device as constructed above, however, the target number of rpm during idling is set at a prescribed value irrespective of engine operating conditions, and the number of engine rpm is generally controlled to be maintained at the target value even during a fast idling operation of the engine in which the engine temperature (i.e., engine coolant temperature) is low and the rotational speed of the engine should be held higher than that during the time when the engine temperature is high, so as to enable a more complete combustion of an air/fuel mixture for preventing the degradation of the engine exhaust due, for example, to the increased generation of carbon monoxide, as well as for avoiding the lengthening of an engine warming-up period. As a result, the aforementioned known idle control device is not feasible for controlling the idling operation of the engine over wide operating conditions thereof.

In addition, with the above described idle control device, an idling operation of the engine is detected from the output signals of various sensors such as an idle switch, a boost sensor, a throttle sensor and the like, and when it is detected that the engine is idling, the idle control device performs idle control, i.e., it operates to control the number of engine rpm to be at the prescribed target value. In this case, however, if one or more of the switch or sensors for determining an idling operation of the engine fails, it becomes impossible to determine whether the engine is idling or not so that if there arises an abnormality in the engine operation such as, for example, a great change in the number of rpm, engine stall and the like, the idle control device is no longer able to control the engine operation in an appropriate manner.

SUMMARY OF THE INVENTION

Accordingly, the present invention is intended to obviate the above described disadvantages of the known idle control device.

It is an object of the present invention to provide a novel and improved idle control device for an internal combustion engine which is capable of controlling the idle speed of the engine in an appropriate manner over a wide operating range thereof including a fast idling operation.

It is another object of the present invention to provide a novel and improved idle control device for an internal combustion engine which is capable of performing idle stabilization control when the engine operation is abnormal irrespective of failure in various switches or sensors for determining an idle operation of the engine.

According to one aspect of the present invention, there is provided an idle control device for an internal combustion engine comprising:

a signal generator for generating an output signal in synchronism with the rotation of the engine;

sensor means for sensing various operating conditions of the engine;

engine operating condition determining means for determining based on the outputs of the sensor means whether the engine is in a fast idling state, a normal idling state or other operating states;

target value selecting means for selecting, based on the output signal of the engine operating condition determining means, a first target value for normal idling when the engine is determined to be in the normal idling state, and a second target value for fast idling, which is higher than the first target level, when the engine is determined to be in the fast idling state; and control means for controlling the number of revolutions per minute of the engine based on the output signals of the signal generator and the target value selecting means, the control means being operable to calculate the number of revolutions per minute of the engine based on the output signal of the signal generator and control the operation of the engine in such a manner that the number of revolutions per minute of the engine is made equal to the first target level when the engine is in the normal idling state, whereas the number of revolutions per minute of the engine is made equal to the second target level when the engine is in the fast idling state.

In this case, it is preferable that the sensor means sense the temperature of the engine, the on-off state of an idle switch, the intake pressure in an intake manifold of the engine, and the opening degree of a throttle valve disposed in the intake manifold.

Preferably, the engine operating condition determining means determines the engine to be in the fast idling state when the following conditions are all met;

1) the engine temperature is lower than a prescribed level;

2) the idle switch is turned on;

3) the intake pressure is less than a prescribed pressure level; and 4) the opening degree of the throttle valve is less than a prescribed opening degree. On the other hand, the engine operating condition determining means determines the engine to be in the normal idling state when the condition 1) above is not satisfied and when the conditions 2) through 4) above are all met.

According to another aspect of the present invention, there is provided an idle control device for an internal combustion engine comprising:

a signal generator for generating an output signal in synchrony with the rotation of the engine;

sensor means for sensing various operating conditions of the engine;

control means for controlling, based on the output signal of the signal generator, the operation of the engine so that the number of revolutions per minute of the engine is made equal to a target idling value;

engine operating condition determining means for determining, based on the outputs of the sensor means, whether or not the engine is in an idling state, the engine operating condition determining means controlling the control means in such a manner that the control means is permitted to control the operation of the engine so as to make the number of engine rpm equal to the target idling value only when the engine is determined to be idling; and engine abnormality determining means for determining whether the operation of the engine is normal or abnormal and controlling the control means in such a manner that the control means is permitted to control the operation of the engine so as to make the number of engine rpm equal to the target idling value only when the operation of the engine is determined to be abnormal.

In this case, it is preferable that the sensor means sense the on-off state of an idle switch, the intake pressure in an intake manifold of the engine, and the opening degree of a throttle valve disposed in the intake manifold.

Preferably, the engine operating condition determining means determines the engine to be idling when the following conditions are all met:

1) the idle switch is turned on;

2) the intake pressure is less than a prescribed pressure level; and 3) the opening degree of the throttle valve is less than a prescribed opening degree.

Preferably, the engine abnormality determining means successively calculates, based on the output signal of the signal generator, a number of engine rpm, an average number of engine rpm, and a variation between the present number of rpm and the preceding number of rpm, and determines the operation of the engine to be abnormal when at least one of the following conditions is met:

A) the average number of engine rpm continuously remains less than a prescribed threshold, which is lower than the target idling value, for more than a predetermined period of time; and B) the variation between the present number of rpm and the preceding number of rpm is greater than a prescribed value.

Preferably, the control means calculates a number of engine rpm and an average number of engine rpm based on the output signal of the signal generator, determines whether the average number of rpm thus calculated is less than a prescribed idle threshold, calculates a deviation between the average number of rpm and the target idling value, and controls the operation of the engine based on the deviation thus calculated so as to make the number of engine rpm equal to the target idling value when it is determined that the average number of rpm is less than the prescribed idle threshold.

In a preferred embodiment, a switch is connected to the output terminal of the control means for controlling the transmission of the output signal of the control means. A switch-operating means generates, based on the output signal of the engine operating condition determining means, an output signal for closing the switch when the engine is determined to be idling. An OR gate having a first input terminal coupled to receive the output signal of the switch-operating means, a second input terminal coupled to receive the output signal of the engine abnormality determining means, and an output terminal for outputting a control signal to the switch, operates to close the switch when at least one of the outputs of the switch-operating means and the engine abnormality determining means is inputted to the corresponding input terminal thereof.

According to a further aspect of the present invention, there is provided an idle control device for an internal combustion engine comprising:

a signal generator for generating an output signal in synchrony with the rotation of the engine;

sensor means for sensing various operating conditions of the engine;

control means for generating, based on the output signal of the signal generator, an output signal which controls the operation of the engine so as to make the number of revolutions per minute of the engine equal to a target idling value, the control means having a first input terminal connected to receive the output signal of the signal generator, a second input terminal to which a reference signal indicative of the target idling value is inputted, and an output terminal for outputting a control signal for controlling the engine operation;

a switch connected to the output terminal of the control means for controlling the transmission of the output signal of the control means;

engine operating condition determining means for determining based on the outputs of the sensor means whether or not the engine is in an idling state;

switch-operating means for generating, based on the output signal of the engine operating condition determining means, an output signal for closing the switch when the engine is determined to be idling;

engine abnormality determining means for determining whether the operation of the engine is normal or abnormal and generating an output signal when there is an abnormality in the engine operation; and an OR gate having a first input terminal coupled to receive the output signal of the switch-operating means, a second input terminal coupled to receive the output signal of the engine abnormality determining means, and an output terminal for controlling the opening and closing of the switch, the OR gate being operable to output a control signal for closing the switch when at least one of the outputs of the switch-operating means and the engine abnormality determining means is inputted to the corresponding input terminal thereof.

The above and other objects, features and advantages of the present invention will become apparent from the following detailed description of a few presently preferred embodiments of the invention taken in conjunction with the accompanying drawings.

DESCRIPTION OF THE PREFERRED EMBODIMENTS

The present invention will now be described in detail with reference to a few presently preferred embodiments as illustrated in the accompanying drawings.

Figure 1:
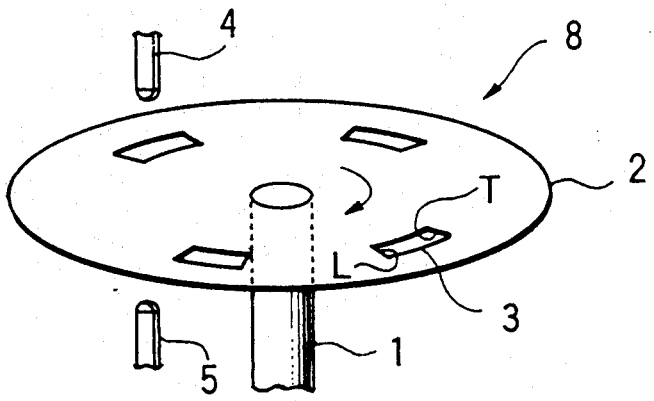
FIG. 1 is a perspective view schematically showing the arrangement of a known signal generator.
Figure 2:
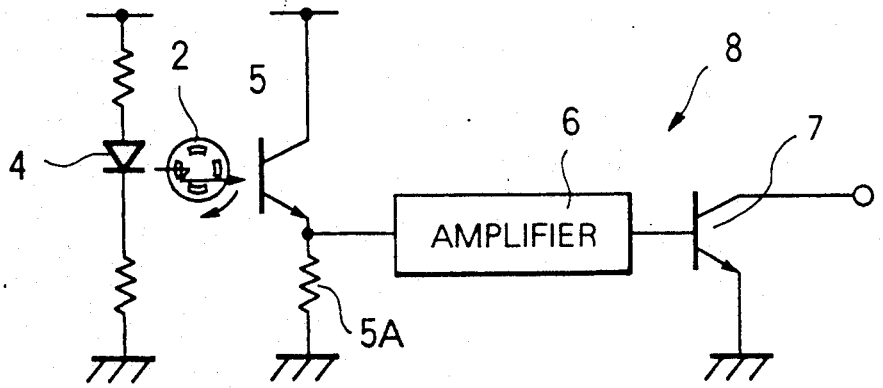
FIG. 2 is a circuit diagram of the signal generator shown in FIG. 1.
Figure 5:
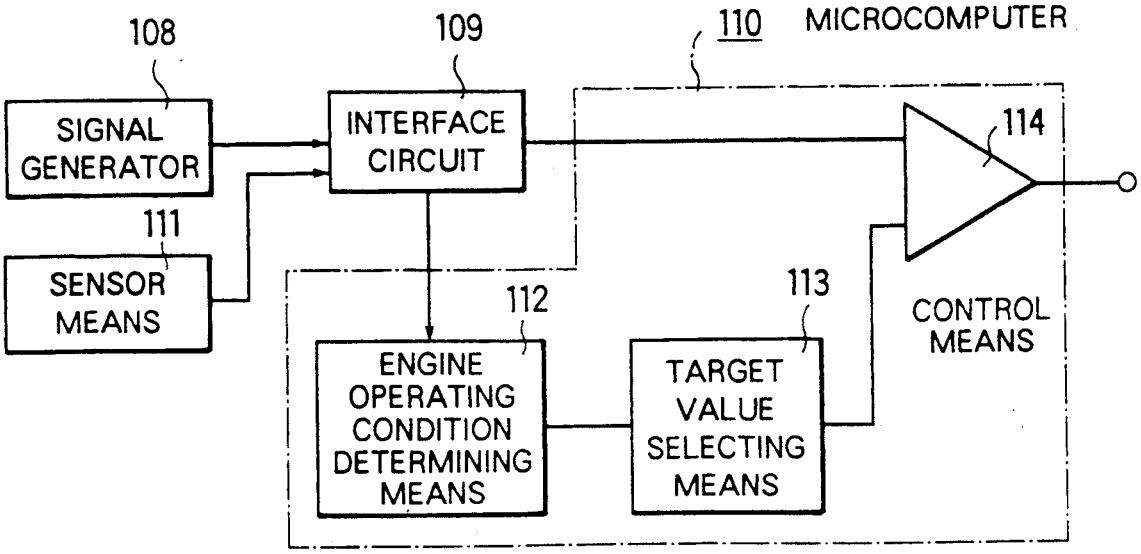
FIG. 5 is a block diagram of an idle control device for an internal combustion engine according to a first embodiment of the present invention.

Referring to the drawings and first to FIG. 5 which illustrates a first embodiment of the present invention, the idle control device illustrated includes a signal generator 108 which is the same as the one 8 of FIGS. 1 and 2, an interface circuit 109, a microcomputer 110 and sensor means 111 in the form of a plurality of sensors for sensing various operating conditions of an engine. For example, the sensor means 111 includes an engine temperature sensor for sensing the temperature of the engine, an idle switch which is turned on for generating an output signal when the engine is idling, a boost sensor for sensing the intake pressure in an intake manifold, a throttle sensor for sensing the opening degree of a throttle valve in the intake manifold, and the like. The output signals from the signal generator 108 and the sensor means 111 are inputted to the microcomputer 110 via the interface circuit 109. The microcomputer 110 includes an engine operating condition determining means 112 for sensing the operating conditions of the engine based on the outputs of the sensors 111, a target value selecting means 113 for selecting an appropriate target number of engine rpm depending upon the operating conditions of the engine as sensed by the engine operating condition determining means 112, and a control means 114 in the form of a modification calculating means having a first input terminal for receiving the output signal of the signal generator 108 via the interface 109, a second input terminal for receiving the output of the target value selecting means 113, and an output terminal for outputting a control signal to an appropriate engine controller (not shown) so as to make the number of engine rpm equal to the target value selected by the target value selecting means 113. For example, the controller may be a conventional ignition timing controller, which is well known in the art, for controlling the ignition timing of the engine in such a manner that the number of engine rpm is made to approach the target value. However, the controller may be another type of controller which can control the number of engine rpm in an appropriate manner.

Figure 3:
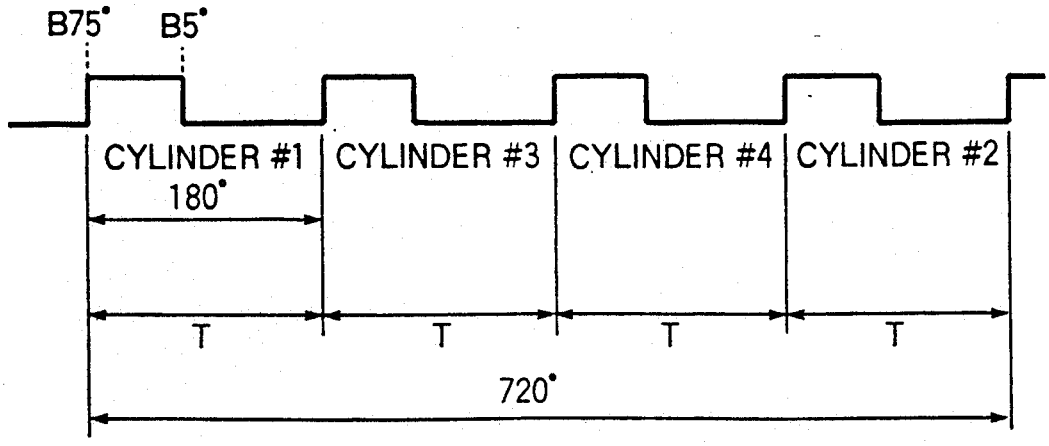
FIG. 3 is a wave form diagram of the output signal of the signal generator of FIGS. 1 and 2.
Figure 4:
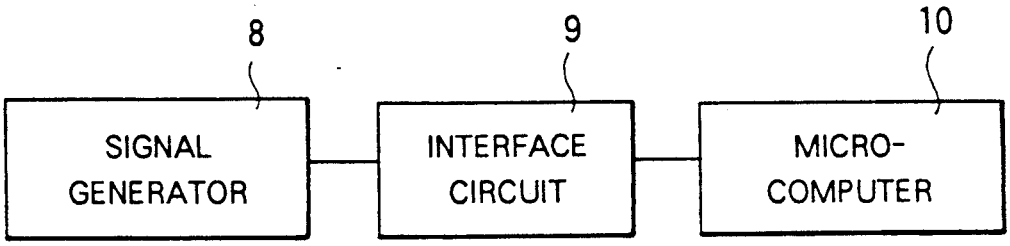
FIG. 4 is a block diagram of a known idle control device for an internal combustion engine.

In operation, the output signal of the signal generator 108 is inputted via the interface circuit 109 to the first input terminal of the modification calculating means 114 where the instant or present number of rpm of the engine ($N_{IDL}$) is successively calculated, for example, by measuring the length of time (T) between the rising or falling edges of two successive pulses (i.e., between the rising or falling edge of the present pulse and the rising or falling edge of the preceding pulse) of the output signal of the signal generator 108, as referred to before in detail with reference to FIG. 3. Based on the instant or present number of rpm ($N_{IDL}$) thus calculated, the modification calculating means 114 then determines an instant or present average number of revolutions per minute of the engine ($N_{AVE}$ (n)) using the following formula:

$$N_{AVE}=N_{AVE}(n-1)+K\{N_{AVE}(n-1)-N_{AVE}(n)\} \quad (1)$$

where $N_{AVE}(n-1)$ is the preceding average number of rpm, and K is an averaging constant.

On the other hand, the output signals of the various sensors 111 such as an engine temperature sensor, an idle switch, a boost switch, a throttle sensor and the like are inputted via the interface circuit 109 to the engine operating condition determining means 112 where the present operating conditions such as the temperature of the engine, the on-off condition of the idle switch, the boost or intake pressure in the intake manifold, the opening degree of the throttle valve, and the like are sensed so that it is determined based on these factors as sensed whether the engine is in a fast or normal idling condition. For example, the engine is determined to be in a fast idling condition when the following conditions are all met:

1) the engine temperature is lower than a prescribed level;

2) the idle switch is turned on;

3) the intake pressure is less than a prescribed pressure level; and 4) the opening degree of the throttle valve is less than a prescribed opening degree.

Based on the engine operating conditions thus determined by the engine operating condition determining means 112, the target value selecting means 113 selects an appropriate target number of rpm which is suited to the sensed engine operating condition. For example, if the engine temperature as sensed is higher than the prescribed level and if the other conditions 2) through 4) above are all satisfied, it is determined that the engine is in a normal idling condition. In this case, the target value selecting means 113 selects a prescribed first target number of rpm ($N_{TID1}$) for normal idling. On the other hand, if the above conditions 1) through 4) are all satisfied, the engine is determined to be in a fast idling condition and then the target value selecting means 113 selects a second target number of rpm ($N_{TID2}$) for fast idling which is higher than the first target value ($N_{TID1}$) for normal idling. The output of the target value selecting means 113 is then inputted to the second input terminal of the modification calculating means 114 where the present average number of engine rpm ($N_{AVE}$) as calculated above is compared with the output (the first target value ($N_{TID1}$) or the second target value ($N_{TID2}$)) of the target value selecting means 113 so as to obtain a deviation therebetween, and a quantity of ignition timing modification ($\theta_{ISC}$) is calculated based on the following formula:

$$\theta_{ISC}=(N_{TID}-N_{AVE}(n))*K_{10} \quad (2)$$

where NTID is ($N_{TID1}$) or ($N_{TID2}$) and $K_{10}$ is a conversion constant.

The ignition timing controller then controls ignition timing in such a manner that the predetermined ignition timing is modified by the quantity of ignition timing modification ($\theta_{ISC}$) thus calculated, thereby causing the number of engine rpm to become the target number of rpm ($N_{TID1}$ or $N_{TID2}$). From formula (2) above, it will be seen that the ignition timing is modified in the ignition-advancing direction when the average number of rpm ($N_{AVE}$(n)) of the engine is less than the target number of rpm ($N_{TID1}$ or $N_{TID2}$) whereas the ignition timing is modified in the ignition-retarding direction when the average number of rpm ($N_{AVE}$(n)) is greater than the target number of rpm ($N_{TID1}$ or $N_{TID2}$).

In this manner, the number of engine rpm is controlled to be at the second target value during the fast idling operation of the engine so that any undesirable control of maintaining the number of engine rpm at the first target value, which is suitable for normal idling but undesirably low for fast idling, can be avoided, thus effectively preventing an undesirable degradation of exhaust emissions of the engine due to increased generation of noxious components such as carbon monoxide and the like contained therein as well as an undesirable increase in the engine wormingup period.

In this connection, it is to be noted that the second target value may be varied in accordance with the operating conditions of the engine.

Figure 6:
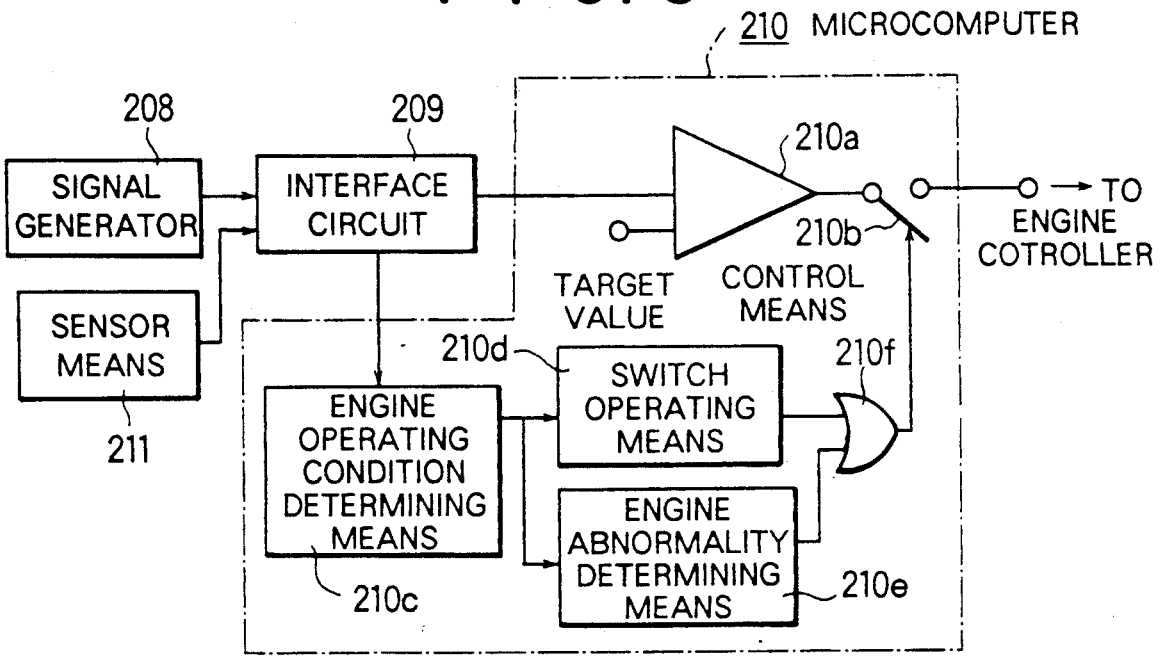
FIG. 6 is a block diagram of an idle control device for an internal combustion engine according to a second embodiment of the present invention.

FIG. 6 shows another embodiment of the present invention. The idle control device of this embodiment includes, in addition to a signal generator 208, an interface circuit 209 and sensor means 211 which are the same as the elements 108, 109 and 111 of the previous embodiment illustrated in FIG. 5, a microcomputer 210 which is different in operation from the one 110 of the previous embodiment. Specifically, the microcomputer 210 of this embodiment comprises a control means **210*a* in the form of a modification calculating means which has a first input terminal connected to receive the output signal from the signal generator 208 via the interface circuit 209, a second input terminal onto which a reference signal indicative of a target idling number of rpm is imposed, and an output terminal connected through an on-off switch 210*b* to an engine controller (not shown) such as an ignition controller which controls the idling operation of the engine so as to maintain the number of rpm at the prescribed target idling number of rpm, an engine operating condition determining means 210*c* connected to receive the output signals from the signal generator 208 and the sensor means 211 via the interface circuit 209 for determining the operating conditions of the engine based on the input signals and generating an output signal representative of the sensed engine operating conditions, a switch-operating means 210*d* for opening and closing the switch 210*b* based on the output signal of the engine operating condition determining means 210*c*, an engine abnormality determining means 210*e* for determining, based on the output signal of the engine operating condition determining means 210*c*, whether the operation of the engine is normal or abnormal, and outputting a control signal for closing the switch 210*b* when it is determined that the engine is abnormal, and an OR gate 210*f* having a first input terminal coupled to receive the output signal of the switchoperating means 210*d* and a second input terminal coupled to receive the output signal of the engine abnormality determining means 210*e*, and an output terminal for controlling the on-off switching operation of the switch 210*b***.

The modification calculating means **210*a* operates to successively calculate an instant or present number of rpm and an average number of rpm of the engine from the output signal of the signal generator 208, for example, in the same manner as in the previous embodiment of FIG. 5, and determines whether the average number of rpm thus calculated is lower than an idle threshold (e.g., 1,000 rpm). If the answer is "YES", then the modification calculating means 210*a*** calculates a deviation of the average number of engine rpm from the target idling number of rpm, which is inputted to the second input terminal thereof and which is lower than the idle threshold, and modify the ignition timing based on the deviation thus calculated in such a manner as to maintain the number of engine rpm at the target number of rpm.

The operation of this embodiment will now be described in detail while referring to the flow chart of FIG. 7. The output signal of the signal generator 208, as shown in FIG. 3, is inputted via the interface circuit 209 to the modification calculating means **210*a*** which operates based on the signal generator output in the manner as referred to above.

Figure 7:
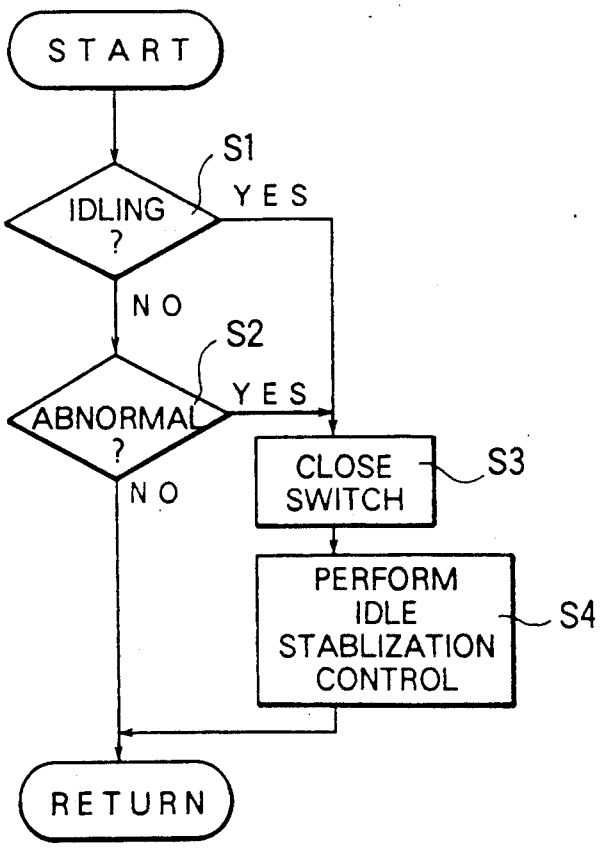
FIG. 7 is a flow chart showing the operation of the idle control device of FIG. 6.

On the other hand, the output signals of the sensor means 211 including an engine temperature sensor, an idle sensor, a boost sensor, a throttle sensor, etc., representative of the various engine operating conditions as well as the output signal of the signal generator 208 are inputted via the interface circuit 209 to the engine operating condition determining means 210*c* which, in Step S1 of FIG. 7, determines, based upon the output signals of the sensor means 211, whether or not the engine is idling. More specifically, the engine is determined to be idling if the following conditions are all met:

1) the idle switch is turned on;

2) the intake pressure is less than a prescribed pressure level; and 3) the opening degree of the throttle valve is less than a prescribed opening degree.

If it is determined in Step S1 that the engine is idling, the engine operating condition determining means 210*c* generates an output signal representative of the engine idling condition which is sent to the switch-operating means 210*d* whereby a closing signal is fed therefrom to the switch 210*b* via the OR gate 210*f* for the closure thereof (Step S3). Thus, with the switch 210*b* now closed, a control signal outputted by the modification calculating means 210*a* is transmitted therethrough to the unillustrated engine controller such as an ignition controller which then controls an engine operation such as ignition timing in an appropriate manner so as to make the number of engine rpm equal to the target number of rpm (Step S4).

On the other hand, if all the conditions 1) through 3) above are not satisfied, the engine may be or may not be in an idling operation. Namely, if one or more of the sensors fails, one or more of the above conditions relating to the failed sensor(s) is not satisfied even when the engine is in fact idling. In this case, the engine operating condition determining means 210*c* generates an output signal representative of the engine non-idling operation which is sent to the engine abnormality determining means 210*e* where it is determined, (based on the output signal of the signal generator 208 which is fed thereto via the interface circuit 209 and the engine operating condition determining means 210*c*,) whether the operation of the engine is normal or abnormal (Step S2). In this case, the engine abnormality determining means 210*e* may successively calculates, based on the output signal of the signal generator 208 inputted thereto via the interface circuit 209 and the engine operating condition determining means 210, a number of engine rpm and an average number of engine rpm every predetermined number of engine revolutions or every predetermined engine operation (e.g., ignition instant), and a variation between the present average number of rpm and the preceding average number of rpm, and determines the operation of the engine to be abnormal (e.g., likely to stall) when at least one of the following conditions is met:

A) the average number of engine rpm calculated from the output signal of the signal generator 208 continuously remains less than a prescribed threshold, which is lower than the target idling number of rpm, for more than a predetermined period of time; and B) the variation between the present average number of rpm and the preceding average number of rpm is greater than a prescribed value.

Thus, when it is determined in Step S2 that the engine is abnormal even if the engine is determined not to be in an idling operation due to failure in the sensors 211, the engine abnormality determining means 210*e* generates an output signal which is fed to the second input terminal of the OR gate 210*f* whereby a control signal is outputted therefrom to the switch 210*b* for the closure thereof (Step S3). As a result, the output signal of the modification calculating means 210*a* is transmitted via the now closed switch 210*b* to the unillustrated engine controller so that the number of engine rpm is made equal to the target value (Step S4). In this manner, the idling operation of the engine is stabilized irrespective of failure in the sensors 211, thus avoiding any possible engine stall.

Although in the above description, the engine abnormality determining means 210*e* calculates the number of engine rpm, the average number of engine rpm and the variation between the present average number of rpm and the preceding average number of rpm, these calculations can instead be done by the engine operating condition determining means 210*c* or the control means 210*a*, and the results of such calculations can be inputted to the engine abnormality determining means 210*e*.

What is claimed is:

1. An idle control device for an internal combustion engine comprising:

a signal generator for generating an output signal in synchronism with rotation of the engine;

sensor means for sensing a plurality of operating conditions of the engine;

engine operating condition determining means for determining, based on outputs of said sensor means, whether the engine is in one of a normal idling state requiring a normal idling speed, a fast idling state requiring an idling speed faster than said normal idling speed, and a non-idling operating state;

target value selecting means for selecting, based on an output signal of said engine operating condition determining means, a first target value for said normal idling speed when the engine is determined to be in the normal idling state, and a second target value for said faster idling speed, which is higher than the first target value, when the engine is determined to be in the fast idling state; and control means for controlling the number of revolutions per minute of the engine based on output signals of said signal generator and said target value selecting means, said control means being operable to calculate the number of revolutions per minute of the engine based on the output signal of said signal generator and control the operation of the engine in such a manner that the number of revolutions per minute of the engine is made equal to the first target value when the engine is in the normal idling state, whereas the number of revolutions per minute of the engine is made equal to the second target value when the engine is in the fast idling state.

2. An idle control device as claimed in claim 1, wherein said sensor means senses temperature of the engine, on-off state of an idle switch, intake pressure in an intake manifold of the engine, and the opening degree a throttle valve disposed in the intake manifold.

3. An idle control device as claimed in claim 2, wherein said engine operating condition determining means determines the engine to be in the fast idling state when the following conditions are all met:

1) the engine temperature is lower than a predetermined level;
2) the idle switch is turned on;
3) the intake pressure is less than a predetermined pressure level; and
4) the opening degree of the throttle valve is less than a predetermined opening degree; whereas said engine operating condition determining means determines the engine to be in the normal idling state when the condition 1) above is not satisfied and when the conditions 2) through 4) above are all met.

4. An idle control device for an internal combustion engine comprising:

a signal generator for generating an output signal in synchronism with the rotation of the engine;

sensor means for sensing several operating conditions of the engine;

control means for controlling, based on the output signal of said signal generator, the operation of the engine so that a number of revolutions per minute (rmps) of the engine is made equal to a target idling speed value;

engine operating condition determining means for determining, based on outputs of said sensor means, whether or not the engine is in an idling state, said engine operating condition determining means controlling said control means in such a manner that said control means is permitted to control the operation of the engine so as to make the number of engine rpms equal to the target idling value only when the engine is determined to be idling; and engine abnormality determining means for determining whether the operation of the engine is normal or abnormal and controlling said control means in such a manner that said control means is permitted to control the operation of the engine so as to make the number of engine rpms equal to the target idling value only when the operation of the engine is determined to be abnormal.

5. An idle control device as claimed in claim 4, wherein said sensor means senses on-off state of an idle switch, intake pressure in an intake manifold of the engine, and opening degree of a throttle valve disposed in the intake manifold.

6. An idle control device as claimed in claim 5, wherein said engine operating condition determining means determines the engine to be in said idling state when the following conditions are all met:

1) the idle switch is turned on;
2) the intake pressure is less than a predetermined pressure level; and
3) the opening degree of the throttle valve is less than a predetermined opening degree.

7. An idle control device as claimed in claim 4, wherein said engine abnormality determining means successively calculates, based on the output signal of said signal generator, a number of engine rpms every engine revolution, an average number of engine rpms, and a variation between the present number of rpms and the preceding number of rpms, and determines the operation of the engine to be abnormal when at least one of the following conditions is met:

A) the average number of engine rpms continuously remains less than a predetermined threshold, which is lower than the target idling value, for more than a predetermined period of time; and B) the variation between the present number of rpms and the preceding number of rpms is greater than a predetermined value.

8. An idle control device as claimed in claim 4, wherein said control means calculates a number of engine rpms and an average number of engine rpms based on the output signal of said signal generator, determines whether the average number of rpms thus calculated is less than a predetermined idle threshold, calculates a deviation between the average number of rpms and the target idling value, and controls the operation of the engine based on the deviation thus calculated so as to make the number of engine rpms equal to the target idling value when it is determined that the average number of rpms is less than the predetermined idle threshold.

9. An idle control device as claimed in claim 4, further comprising:

a switch connected to an output terminal of said control means for controlling transmission of an output signal of said control means;

switch-operating means for generating, based on an output signal of said engine operating condition determining means, an output signal for closing said switch when the engine is determined to be idling; and an OR gate having a first input terminal coupled to receive the output signal of said switch-operating means, a second input terminal coupled to receive an output signal of said engine abnormality determining means, and an output terminal for outputting a control signal to said switch, said OR gate being operable to close said switch when at least one of outputs of said switch-operating means and said engine abnormality determining means is inputted to a corresponding input terminal thereof.

10. An idle control device for an internal combustion engine comprising:

a signal generator for generating an output signal in synchronism with the rotation of the engine;

sensor means for sensing a plurality of operating conditions of the engine;

control means for generating, based on the output signal of said signal generator, an output signal which controls the operation of the engine so as to make the number of revolutions per minute (rpms) of the engine equal to a target idling value, said control means having a first input terminal connected to receive the output signal of said signal generator, a second input terminal to which a reference signal indicative of the target idling value is inputted, and an output terminal for outputting a control signal for controlling the engine operation;

a switch connected to the output terminal of said control means for controlling transmission of the output signal of said control means;

engine operating condition determining means for determining, based on outputs of said sensor means, whether or not the engine is in an idling state;

switch-operating means for generating, based on an output signal of said engine operating condition determining means, an output signal for closing said switch when the engine is determined to be idling;

engine abnormality determining means for determining whether the operation of the engine is normal or abnormal and generating an output signal when there is an abnormality in the engine operation; and an OR gate having a first input terminal coupled to receive the output signal of said switch-operating means, a second input terminal coupled to receive the output signal of said engine abnormality determining means, and an output terminal for controlling opening and closing of said switch, said OR gate being operable to output a control signal for closing said switch when at least one of the outputs of said switch-operating means and said engine abnormality determining means is inputted to a corresponding input terminal of said OR gate.

11. An idle control device as claimed in claim 10, wherein said sensor means senses an on-off state of an idle switch, intake pressure in an intake manifold of engine, and the opening degree of a throttle valve disposed in the intake manifold.

12. An idle control device as claimed in claim 11, wherein said engine operating condition determining means determines the engine to be idling when the following conditions are all met:

1) the idle switch is turned on;
2) the intake pressure is less than a predetermined pressure level; and
3) the opening degree of the throttle valve is less than a predetermined opening degree.

13. An idle control device as claimed in claim 10, wherein said engine abnormality determining means successively calculates, based on the output signal of said signal generator, a number of engine rpms, an average number of engine rpms, and a variation between the present number of rpms and the preceding number of rpms, and determines the operation of the engine to be abnormal when at least one of the following conditions is met:

A) the average number of engine rpms continuously remains less than a predetermined threshold, which is lower than the target idling value, for more than a predetermined period of time; and
B) the variation between the present number of rpms and the preceding number of rpms is greater than a predetermined value.

14. An idle control device as claimed in claim 10, wherein said control means calculates a number of engine rpms and an average number of engine rpms based on the output signal of said signal generator, determines whether the average number of rpms thus calculated is less than a predetermined idle threshold, calculates a deviation between the average number of rpms and the target idling value, and controls the operation of the engine based on the deviation thus calculated so as to make the number of engine rpms equal to the target idling value when it is determined that the average number of rpms is less than the predetermined idle threshold.

* * * * *